United States Patent [19]

Rumph

[11] 4,334,705

[45] Jun. 15, 1982

[54] DOOR LOCK

[76] Inventor: Joel D. Rumph, 8875 Armaria Ct., Elk Grove, Calif. 95624

[21] Appl. No.: 18,064

[22] Filed: Mar. 6, 1979

[51] Int. Cl.[3] ..... E05C 19/18

[52] U.S. Cl. ..... 292/288

[58] Field of Search ..... 292/244, 258, 288, 289, 292/DIG. 2

[56] References Cited

U.S. PATENT DOCUMENTS

| | | | |
|---|---|---|---|
| 827,624 | 7/1906 | Foster | 292/288 |
| 1,239,802 | 9/1917 | Macbeth | 292/258 |
| 2,396,982 | 3/1946 | Bousguet | 292/258 X |
| 4,004,833 | 1/1977 | Hull | 292/288 |
| 4,012,065 | 3/1977 | Miller | 292/288 |
| 4,082,334 | 4/1978 | Volta et al. | 292/288 |

*Primary Examiner*—Richard E. Moore

*Attorney, Agent, or Firm*—Donald E. Nist

[57] ABSTRACT

The improved door lock comprises, in combination, means for engaging a doorknob to releasably grip it and means secured to the doorknob-engaging means and adapted to releasably grip the leading edge of a doorjamb adjacent a doorknob gripped by the doorknob-engaging means. The retaining means prevents the doorknob and the door to which the doorknob is attached from being swung out and away from the lock. The lock is adapted to fit into the corner between the doorjamb and the door and to slide over that doorjamb down into contact and around the doorknob. When it is desired to remove the lock it is merely slid up and away from the doorknob. The lock requires no attachment to either the jamb or the door and can be made in a unitary integral form, preferably generally L-shaped in outline. The doorknob-engaging means can comprise a wall which extends out at right angles to the retaining means which may comprise a plate containing a vertical lip on its front end to engage the leading edge of the doorjamb. The wall may define an inverted generally U-shaped opening in its lower end which is adapted to fit around the narrow rear portion of a doorknob. If desired, a generally U-shaped second opening to be provided in the upper end of the wall and a vertical lip on the free end of the wall so that the lock can be inverted for use on doors containing doorknobs on either end of the door. The lock may also include means for adjusting the spacing of the doorknob-engaging means from the retaining means and may further include means for adjusting the length of the retaining means. The lock is simple, inexpensive, durable, effective, easy to place into operative position and to remove from recessed doors which swing outwardly. The lock can also be used in a modified form on doors set flush with their frames.

7 Claims, 4 Drawing Figures

DOOR LOCK

BACKGROUND OF THE INVENTION

1. Field of the Invention

The present invention generally relates to locks and more particularly to door locks on an improved type.

2. Prior Art

Conventional types of door locks and guards are permanently installed on the doorframe, and/or door or doorknob and either require doorknobs of special construction or substantial drilling, mounting, etc., relative to the door and the doorframe. Doorknob locks of the usual types can be easily picked and opened by an expert burgler. It therefore would be desirable to be able to provide door auxiliary locking means which could be quickly installed without tools and which would ensure that a door could not be opened even if the door lock were picked. Preferably, such locking means should obviate alteration and marring of the doorframe, doorjamb, door and doorknob. Such door locking means preferably should also be easily set in place to prevent opening of the door and as easily removed, and be simple, inexpensive, durable and effective.

SUMMARY OF THE INVENTION

The improved door lock of the present invention satisfies all the foregoing needs. The lock is substantially as set forth in the Abstract above. Thus, it includes a doorknob-engaging means which can be, for example, a wall or plate, with an opening in it to releasably grip the narrow rear portion of a doorknob, and retaining means secured to that wall and adapted to releasably grip the edge of a doorframe adjacent the doorknob to prevent the door to which the doorknob is attached from being swung out and away from the lock. Preferably, the leading edge of the doorjamb is engaged by the retaining means. However, the side edge of the doorframe may be engaged by the retaining means when the door is flush mounted relative to the frame.

The wall which has the doorknob-engaging means may have a substantially horizontal lower edge which engages the narrow neck of a doorknob to releasably grip it. Preferably, the lock is generally L-shaped configuration with the doorknob-engaging wall perpendicular to the retaining means, a plate having a vertical lip on the front end thereof. The wall may include means for adjusting the spacing between the plate and the portion of the wall which grips the doorknob. This is to accommodate doors having doorknobs at various distances from the adjacent doorjamb. The plate which comprises the retaining means may also be adjustable to accommodate doorjambs and/or frames of various widths. The lock may be designed to be inverted and used on doors having doorknobs adjacent either side thereof. The lock is designed to be used on doors which open outwardly rather than inwardly. Further features of the lock are set forth in the following detailed description and accompanying drawings.

DRAWINGS

DETAILED DESCRIPTION

FIG. 1

Figure 1:
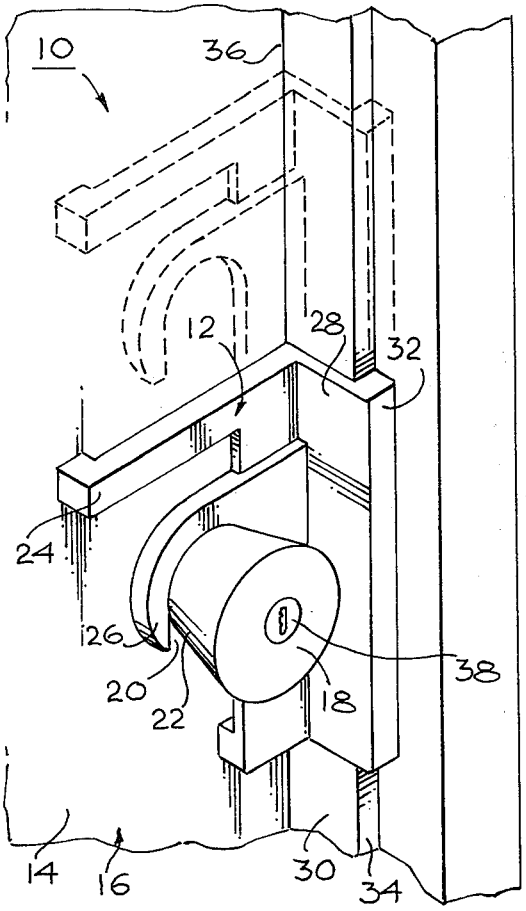
FIG. 1 is a schematic perspective view of a first preferred embodiment of the improved door lock of the present invention.

The first preferred embodiment of the improved door lock of the present invention is schematically depicted in perspective view in FIG. 1. Thus, lock 10 is shown which includes doorknob-engaging means in the form of a wall 12 which is adapted to overlie the front surface 14 of a door 16 containing a doorknob 18 protruding out from surface 14. Wall 12 defines an opening 20 which is generally inverted U-shaped and is dimensioned to fit down around the sides and upper end of the narrow rear portion 22 of doorknob 18. Wall 12 may also include a rear component 24 adapted to properly space front portion 26 of wall 12, which portion defines opening 20, forwardly of door 16.

Wall 12 is joined at a right angle to forwardly extending plate 28, which plate is adapted to overlie doorjamb 30 adjacent knob 18 and contains at its front end a transversely extending vertical lip 32 adapted to abut the leading edge 34 of doorjamb 30. Thus, lock 10 is generally L-shaped and fits into the corner 36 formed by door 16 and doorjamb 30 adjacent knob 18. Plate 28 is of a length such that lip 32 engages edge 34, when lock 10 is placed down around knob 18, as shown in FIG. 1. In this position, door 16, which opens outwardly, cannot be swung open since any attempt to do so is prevented by lip 32 strongly bearing against edge 34. Thus, even if lock 38 in doorknob 18 were picked, door 16 could not be opened unless lock 10 were first removed from its operative position, as by sliding it up to, for example, the position shown in dotted outline in FIG. 1 and removing it. Lock 10 can be made in one piece of metal, such as steel, aluminum, fiberglass, plastic or the like durable material and thus can be inexpensive, durable and effective. Moreover, it does not require any attachment, as by nailing, screwing, threading or the like, to jamb 30 or door 16 and thus does not mar the finish of either door 16 or jamb 30.

FIG. 2

Figure 2:
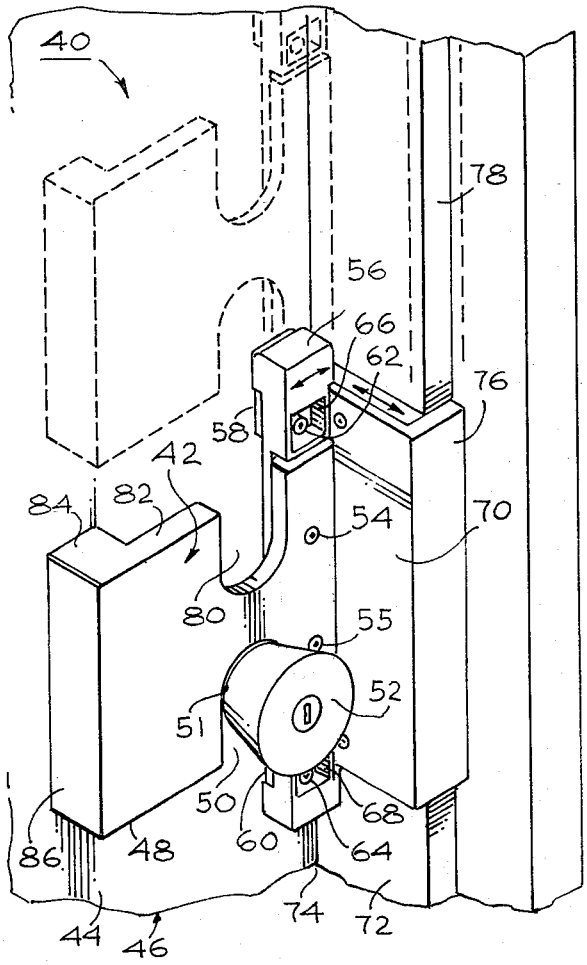
FIG. 2 is a schematic perspective view of a second preferred embodiment of the improved door lock of the present invention

A second preferred embodiment of the improved door lock of the invention is schematically depicted in FIG. 2. Thus, lock 40 is depicted which includes a wall 42 adapted to overlie the front surface 44 of an outwardly opening door 46 and which defines in its lower end 48 a generally inverted U-shaped opening 50 adapted to releasably engage the narrow rear portion 51 of doorknob 52 secured to the front surface 44 of door 46. Wall 42 is secured, as by screws 54 and 55, to a vertical post 56 in turn releasably secured to horizontal posts 58 and 60 by screws 62 and 64 extending through slotted openings 66 and 68 in post 56. Posts 58 and 60 are integral with and extend at right angles from a plate 70 adapted to overlie a doorjamb 72. The slots 66 and 68 and screws 62 and 64 permit wall 42 to be positioned at various points laterally from plate 70 to accommodate various locations of doorknob 52 from corner 74 formed by door 46 and doorjamb 72. It will be noted that plate 70 is perpendicular to wall 46, extending forwardly thereof and includes a vertical front lip 76 parallel with wall 42 and adapted to abut the front edge 78 of doorjamb 72.

Lock 40 also includes an inverted U-shaped opening 80 in the upper end 82 of wall 46 and a vertical rearwardly extending lip 84 on the free end 86 of wall 46 so that lock 40 can be inverted and used on a door (not shown) which has its doorknob (not shown) on the opposite side of the door from that illustrated in FIG. 2. Accordingly, lock 40 is versatile, adjustable, simple and effective to prevent the opening of door 46 when lock 40 is in place. Lock 40 can be slid from the position indicated in dotted outline in FIG. 2, in which position it does not engage doorknob 54, down into the position shown in FIG. 2 wherein it does engage doorknob 52 and locks door 46.

FIG. 3

Figure 3:
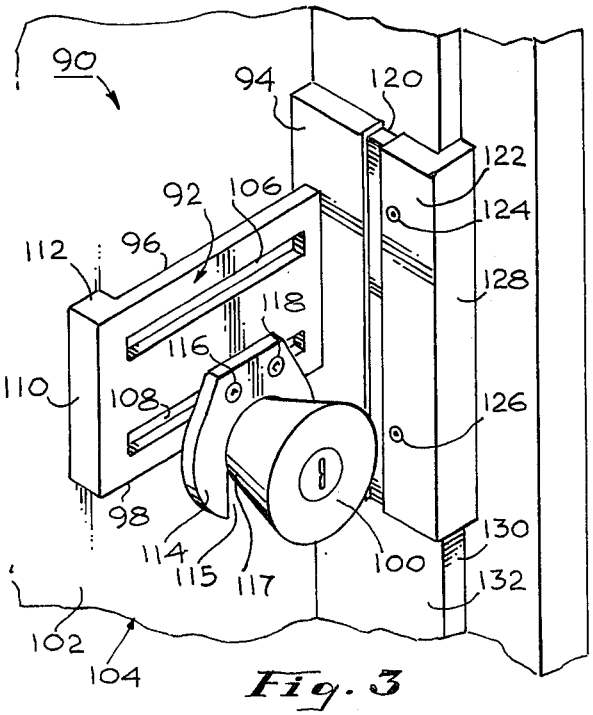
FIG. 3 is a schematic perspective view of a third referred embodiment of the improved door lock of the present invention; and, FIG. 4 is a schematic perspective view of a fourth preferred embodiment of the improved door lock of the present invention.

A third preferred embodiment of the improved door lock of the present invention is schematically depicted in FIG. 3. Thus, lock 90 is shown which comprises a wall 92 secured at right angles to a plate 94. Wall 92 has horizontal upper and lower edges 96 and 98, the latter adapted to engage the narrow neck portion 99 of a doorknob 100 secured to the front 102 of a door 104. Wall 92 has a pair of horizontal slots 106 and 108 therethrough, and the free end 110 of wall 92 has a vertical rearwardly extending lip 112 adapted to engage the edge of a doorjamb when lock 90 is inverted. A bracket 114 having an inverted generally U-shaped opening 115 releasably grips the narrow portion 99 of doorknob 100 and is releasably secured, as by screws 116 and 118, through slot 108 to wall 92.

Plate 94 includes a forwardly extending tongue 120 slideably received within an opening or groove (not shown) in the front portion 122 of plate 94 so that plate 94 is adjustable in length, screws 124 and 126 releasably engaging tongue 120 through portion 122. Portion 122 includes a terminal lip 128 parallel with all 92 and adapted to abut the front edge 130 of doorjamb 132 adjacent doorknob 100. Thus, lock 90 is generally L-shaped, fits into the corner 134 formed by doorjamb 132 and door 104 and can be slid up to disengage from doorknob 104. Lock 90 is invertible so that it can be used, as was the case with lock 40, on a door containing a doorknob on the opposite side from that shown on FIG. 3. Bracket 114 can be removed and used in slot 106 when lock 90 is inverted. Alternatively, edge 96 can be used by itself to engage the narrow neck of a doorknob. Thus, lock 90 has the advantages of lock 40 and lock 10.

FIG. 4

Figure 4:
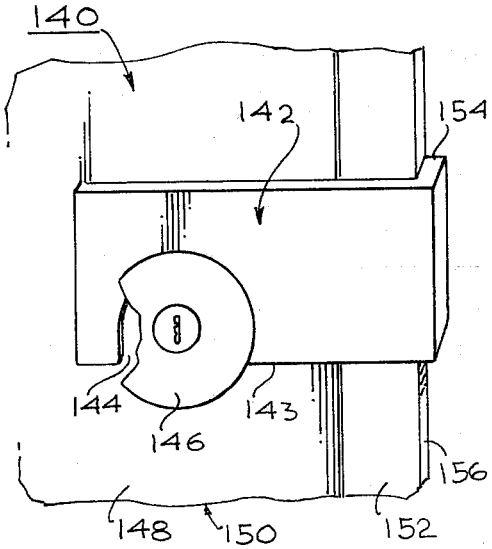

A fourth preferred embodiment of the improved lock of the present invention is schematically depicted in FIG. 4 in a perspective view. Thus, lock 140 is shown which is used on a door which opens outwardly but is mounted flush with its frame in contrast to the conventional recessed doors shown in FIGS. 1, 2 and 3. Lock 140 comprises a flat plate 142 defining in its lower end 143 an inverted generally U-shaped opening 144 releasably engaging the narrow rear portion (not shown) of a doorknob 146 protruding from the front surface 148 of a door 150. Plate 142 extends horizontally across door 150 and over the door frame, molding or doorjamb 152 adjacent doorknob 146 and terminates in a rearwardly extending lip 154 which abuts the outer edge 156 of frame 152.

With lock 140 in place, as shown in FIG. 4, door 150 cannot be swung open. In fact, any attempt to do so would bind lip 154 against edge 156. However, lock 140 can easily be removed from doorknob 146 by sliding it up until plate 142 clears doorknob 146. Lock 140 can then be lifted off and away from frame 152 and door 150. As in the case of locks 10, 40 and 90, lock 140 can be made inexpensively of conventional durable materials and needs no special tools to install.

Various other modifications, changes, alterations and additions can be made in the improved lock of the present invention, its components and parameters. All such changes, modifications, alterations and additions as are within the scope of the appended claims form part of the present invention.

What is claimed is:

1. An improved door lock for outwardly opening doors, said lock comprising, in combination:

a. doorknob-engaging means adapted to releasably grip a doorknob; and, b. retaining means secured to said doorknob-engaging means and adapted to releasably grip the edge of a doorframe adjacent a doorknob gripped by said doorknob-engaging means, so as to prevent a door to which said doorknob is secured from being outwardly opened, said retaining means comprising a plate having one side thereof adapted to overlie a doorjamb, said plate including a front lip adapted to overlie and grip the leading edge of a doorjamb, said doorknob-engaging means extending out from the side of said plate opposite that adapted to overlie a doorjamb, said doorknob-engaging means comprising a wall about perpendicular to said retaining means, said wall including an inverted generally U-shaped doorknob-gripping opening adjacent the lower end thereof, said lock being adapted to be slid down into doorknob-locking position and up out of doorknob engagement.

2. An improved door lock for outwardly opening doors, said lock comprising in combination:

a. doorknob-engaging means adapted to releasably grip a doorknob; and, b. retaining means secured to said doorknob-engaging means and adapted to releasably grip the edge of a doorframe adjacent a doorknob gripped by said doorknob-engaging means, so as to prevent a door to which said doorknob is secured from being outwardly opened, said retaining means comprising a plate having one side thereof adapted to overlie a doorjamb, said plate including a front lip adapted to overlie and grip the leading edge of a doorjamb, said doorknob-engaging means extending out from the side of said plate opposite that adapted to overlie a doorjamb and comprising a wall about perpendicular to said retaining means, said wall including an inverted generally U-shaped doorknob-gripping opening adjacent the lower end thereof, said lock being adapted to be slid down into doorknob-locking position and up out of doorknob engagement, said door lock including means for adjustably spacing said opening from said plate.

3. The improved door lock of claim 2 wherein said door lock is generally L-shaped and has a configuration adapted to fit into the corner formed by a closed door and doorjamb adjacent the doorknob thereof.

4. The improved door lock of claim 2 wherein said door lock includes means for adjustably effectively lengthening said plate.

5. The improved door lock of claim 1 wherein said wall includes a generally U-shaped doorknob-gripping opening defined in the upper surface thereof and a vertical terminal lip on one end thereof, said terminal lip being adapted to function as a doorjamb gripper when said lock is inverted.

6. The improved door lock of claim 1 wherein said door lock is of unitary integral construction.

7. The improved door lock of claim 1 wherein said doorknob-engaging means has a substantially horizontal lower edge adapted to engage the narrow neck portion of a doorknob.

* * * * *